US007093785B2

(12) United States Patent
Meyer et al.

(10) Patent No.: US 7,093,785 B2
(45) Date of Patent: Aug. 22, 2006

(54) TRANSVERSE CUTTING DEVICE FOR A WEB OF MATERIAL AND WINDING DEVICE FOR THE WEB OF MATERIAL

(75) Inventors: Helmut Meyer, Troisdorf (DE); Andreas Böhm, Troisdorf (DE); Christoph Schmitt, Leichlingen (DE)

(73) Assignee: Reifenhäuser GmbH & Co. Maschinenfabrik, Troisdorf (DE)

( * ) Notice: Subject to any disclaimer, the term of this patent is extended or adjusted under 35 U.S.C. 154(b) by 0 days.

(21) Appl. No.: 10/896,744

(22) Filed: Jul. 22, 2004

(65) Prior Publication Data

US 2005/0051662 A1 Mar. 10, 2005

(30) Foreign Application Priority Data

Aug. 7, 2003 (EP) ..... 03018005

(51) Int. Cl.
*B65H 18/14* (2006.01)

(52) U.S. Cl. ..... 242/542.3; 242/527.3; 242/532.2

(58) Field of Classification Search ..... 242/527.2, 242/527.3, 527.4, 532, 542.3, 581, 527.5, 242/532.2

See application file for complete search history.

(56) References Cited

U.S. PATENT DOCUMENTS

| | | | | |
|---|---|---|---|---|
| 2,479,826 A * | 8/1949 | Frick et al. | ..... | 242/128 |
| 2,787,427 A * | 4/1957 | Marczincsin | ..... | 242/527.3 |
| 2,860,839 A * | 11/1958 | Bower | ..... | 242/527.3 |
| 3,592,403 A | 7/1971 | Schmitt et al. | ..... | 242/527.5 |
| 3,752,412 A * | 8/1973 | Byrt | ..... | 242/523.1 |
| 4,637,567 A | 1/1987 | Tanaka et al. | ..... | 242/527.5 |
| 4,852,820 A | 8/1989 | Looser | ..... | 242/527.2 |
| 5,240,196 A * | 8/1993 | Baarfuesser | ..... | 242/527.2 |
| 6,308,908 B1 | 10/2001 | Marchante | ..... | 242/527.3 |
| 6,752,348 B1 * | 6/2004 | Dreckmann et al. | ..... | 242/542.3 |
| 2002/0179769 A1 * | 12/2002 | Dreckmann et al. | ..... | 242/527.3 |

FOREIGN PATENT DOCUMENTS

| | | |
|---|---|---|
| CH | 672 113 A5 | 10/1989 |
| DE | 1 774 101 | 11/1971 |
| DE | 29 36 382 A1 | 4/1980 |
| DE | 37 23 520 C2 | 4/1989 |
| DE | 101 16 973 A1 | 10/2002 |
| DE | 102 02 462 A1 | 5/2003 |

* cited by examiner

*Primary Examiner*—William A. Rivera
*Assistant Examiner*—William E. Dondero
(74) *Attorney, Agent, or Firm*—Pauley Petersen & Erickson

(57) ABSTRACT

A transverse cutting device for a continuously fed-in web of material which is wound onto sequentially positioned winding tubes, wherein the transverse cutting device includes a cutter block which can be displaced transversely with respect to the web of material and can be driven by a drive mechanism in the displacement direction, and in which a cutting blade for the transverse cutting of the web of material is held, wherein the cutter block has an applicator brush trailing the cutting blade, by which the leading edge of the web of material formed while being severed can be successively placed against the circumference of a waiting winding tube. Also, a winding device for winding a continuously fed-in web of material onto sequentially provided winding tubes is proposed, which has a transverse winding device.

14 Claims, 3 Drawing Sheets

TRANSVERSE CUTTING DEVICE FOR A WEB OF MATERIAL AND WINDING DEVICE FOR THE WEB OF MATERIAL

BACKGROUND OF THE INVENTION

1. Field of the Invention

This invention relates to a transverse cutting device for a continuously fed-in web of material wound onto sequentially positioned winding tubes, wherein the transverse cutting device includes a cutter block, which can be displaced transversely with respect to the web of material and can be driven by a drive mechanism in the displacement direction, and in which a cutting blade for the transverse cutting of the web of material is held. This invention also relates to a winding device for winding a continuously fed-in web of material onto sequentially positioned winding tubes, which contains a rotatably driveable contact roller in a conveying device for feeding the web of material.

2. Discussion of Related Art

Webs of material made of plastics, such as webs of films and non-wovens, as well as other web-shaped substrates, are considered.

Transverse cutting devices are known, for example, from German Patent Reference 37 23 520 and are used in winding devices for a continuously fed web of material in order to sever the web of material by transverse cutting during a winding roller change, so that an already wound winding roller can be removed and replaced by a fresh winding roller, on which the winding process is again started. This exchange of the winding rollers occurs without an interruption of the feeding of the web of material. Thus it is important that the leading edge formed during transverse cutting is dependably placed against the circumference of the waiting winding roller, so that the winding process is dependably initiated on this waiting winding roller. In connection with high feeding speeds of the web of material in particular, this placement of the leading edge is often difficult.

It is known from German Patent Reference DE 101 16 973 A1, for example, to place the leading edge of the web of material created in the process of transverse cutting against the circumference of the waiting fresh winding tube by a blowing air stream, wherein also an electrostatic charge between the web of material and the winding tube is created by a charge electrode to cause the adherence of the leading edge of the web of material, which was deflected by the blowing air, on the circumference of the waiting winding tube.

However, this deflection of the leading edge, for example by blowing air, does not occur dependably in all operational states of a winding device thus designed.

SUMMARY OF THE INVENTION

It is one object of this invention to provide a transverse cutting device of the type mentioned above but which has dependable placement of the leading edge of the web of material formed during transverse cutting on the circumference of the waiting winding tube, in a particularly simple and effective way.

In accordance with this invention, this object is attained by a transverse cutting device as described in this specification and in the claims, wherein a cutter block has an applicator brush trailing the cutting blade by which the leading edge formed during transversely cutting the web of material can be successively placed against the circumference of a waiting winding tube.

According to this invention, with an applicator brush designed in this way, which is fixedly arranged together with the cutting blade on the cutter block of the transverse cutting device and is displaced together with it transversely in relation to the web of material by the drive mechanism, a dependable placement of the leading edge of the web of material, formed during transverse cutting, against the circumference of the waiting winding tube is achieved. The applicator brush arranged to trail the cutting blade causes a lifting of the area of the leading edge of the web of material formed immediately prior to this by the leading cutting edge, so that during the displacement movement of the cutter block the web of material is successively severed over the entire width and is directly placed against the circumference of the waiting winding tube. Thus, a large degree of operational dependability of the transverse cutting device in accordance with the invention is achieved.

Advantageous embodiments and further developments of the transverse cutting device in accordance with the invention are described in this specification and in the claims.

For simplifying the lifting and placement of the leading edge against the circumference of the waiting winding tube, the applicator brush has bristles of increasing height starting at its end adjoining the cutting blade.

The bristles of the applicator brush can be made of a flexible, but wear-resistant material, such as horsehair or hog bristles, such as those that have a diameter between 0.05 and 0.1 mm. However, suitable plastic bristles can also be used.

In one embodiment of this invention, the transverse cutting device has an applicator brush fastened on the cutter block and trailing the cutting blade, and has a charging device for the electrostatic charging of the waiting winding tube, so that the leading edge of the web of material cut by the transverse cutting device and placed against the circumference of the waiting winding tube by the applicator brush adheres automatically and without the aid of adhesives or the like to the winding tube.

It is another object of this invention to provide a winding device for winding a continuously fed web of material onto waiting winding tubes, which contains a rotatably driveable contact roller in a conveying device for feeding the web of material.

This object can be attained in accordance with this invention by assigning to the contact roller: a winding station for the winding tube for winding the web of material into a coil; a winding-start station for receiving a fresh winding tube which, during a winding tube change, is used for replacing the winding tube wound with a coil of the web of material in the winding station; and a transverse cutting device for transversely severing the web of material between the winding station and the winding-start station.

The change of the winding tube is performed so that: the winding tube supporting the coil can be removed from the winding station; the transverse cutting device for transversely cutting the web of material can be changed from a standby position into a working position wherein, while transversely cutting the web of material, a leading edge element of the following web of material is formed; the leading edge element of the web of material thus formed can be conducted to the fresh winding tube located in the winding station and can be wound onto the fresh winding tube; and after picking up the leading edge element of the web of material, the fresh winding tube can be transferred from the winding-start station into the winding station.

In one embodiment, the transverse cutting device of the winding device has a particularly great degree of functional dependability and makes possible the placement of the web of material against the circumference of the waiting new winding tube.

Further embodiments of the winding device in accordance with this invention are discussed in this specification and in the claims.

Thus, the winding device in accordance with this invention can also include a charging device, by which the fresh winding tube can be electrostatically charged.

To achieve a good electrostatic charge, the winding tubes are made of an electrically non-conducting material, for example of cardboard or a suitable plastic material.

In a particularly advantageous embodiment, the contact roller of the device in accordance with this invention is also driveable in different directions of rotation, so that winding of the web of material is possible in right-handed rotation, as well as in left-handed rotation, which is explained in greater detail later in this specification.

BRIEF DESCRIPTION OF THE DRAWINGS

Further details and embodiments of this invention are explained in greater detail in view of the drawings representing exemplary embodiments, wherein.

DESCRIPTION OF PREFERRED EMBODIMENTS

Figure 1:
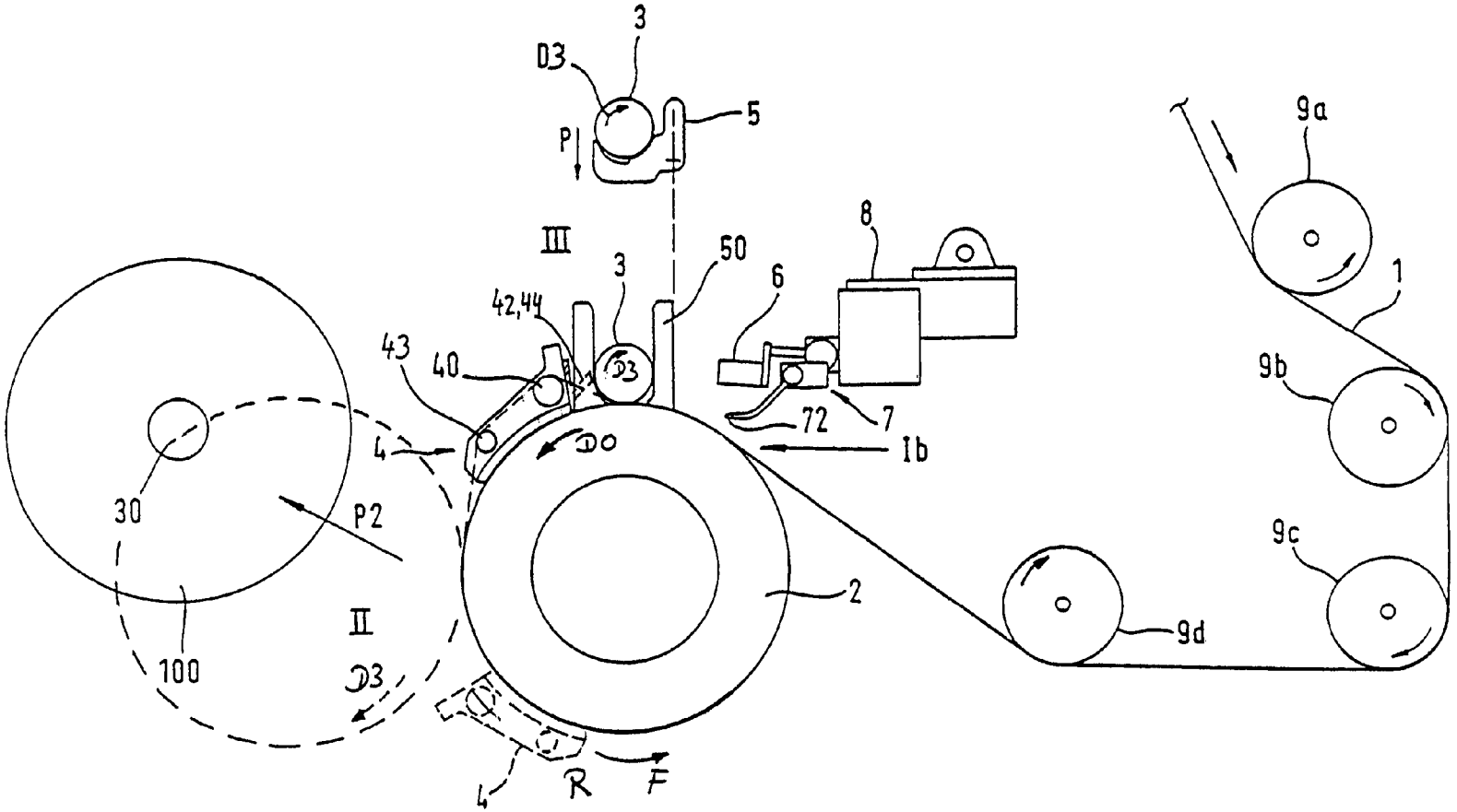
FIG. 1 is a schematic representation of essential elements of a winding device in accordance with this invention, for winding up a continuously fed-in web of material.

A winding device for winding up a continuously fed-in web 1 of material, in particular a web of plastic film, is shown in FIG. 1 in a simplified schematic representation. Only the components essential for performing the winding process are represented in FIG. 1. The web 1 of material is conducted from an extrusion device, not represented, such as a blown film extrusion device or a flat film extrusion device, via a plurality of deflection rollers 9*a*, 9*b*, 9*c*, 9*d* to a contact roller 2. The contact roller 2 is driven by a motor, not represented, and can be rotated either in a counterclockwise direction D0 or also in a clockwise direction. In accordance with the exemplary embodiment in FIG. 1, the contact roller 2 rotates in the counterclockwise direction D0 and the web 1 of material is conducted onto the contact roller 2 in a lead-in station Ib. The web 1 of material fed to the contact roller 2 at Ib is taken along, resting on the circumference of the contact roller 2, to a winding station II and is transferred there to a winding tube 30, which is placed on a winding roller, not represented, and is wound-up into a coil 100 represented in dashed lines. The winding tube 30 is made of an electrically non-conducting material, such as cardboard. The winding tube 30, or the coil 100 as it is slowly wound up on the winding tube 30, is rotated in the direction of the arrow D3 by being driven through contact with the contact roller 2. Because the basis for differentiation between right-handed rotation and left-handed rotation in such a winding device is the direction of rotation of the winding roller with the coil 100 placed on it, and thus is called right-handed rotation of the device in accordance with the direction of rotation D3.

The winding tube 30 in the winding station II with the coil 100 wound on the winding tube 30 can be removed from the contact roller 2 in the direction of the arrow P2 once the coil 100 reaches a desired size. A winding-start station III with a feeding device 5 for fresh winding tubes 3 is also assigned to the contact roller 2 in a 12 o'clock position. Each one of the fresh winding tubes 3 is pushed onto a winding roller in a manner known per se but not represented and, the same as the winding tube 30, includes an electrically non-conducting material, for example cardboard or a plastic material. The winding-start station also includes a storage receptacle 50 for the winding roller of the fresh winding tube 3, as well as a transverse cutting device 4.

The transverse cutting device 4, which will be explained in detail later, includes a cutting blade for the web of material and can be displaced in the direction of the arrow F from the standby position R below the contact roller 2, such as in the 6 o'clock position, into the active position represented in FIG. 2 when it is intended to remove the winding tube 30 wound with a coil 100 from the winding station II, for example it is pivoted in the direction of rotation D0 of the contact roller 2 until it comes to rest immediately in front of the formed coil 100. Then, as also shown in FIG. 2, a fresh winding tube 3 is introduced by the feeding device 5 into the winding-start station III, in which the fresh winding tube 3 rests on the circumference of the contact roller 2 approximately in the 12 o'clock position, with the fed-in web 1 of material interspersed between them, so that it also begins to rotate in the direction of the arrow D3, and the fed-in web 1 of material continues to be fed to the coil 100 between the contact roller 2 and the fresh winding roller 3 running off on it.

Figure 2:
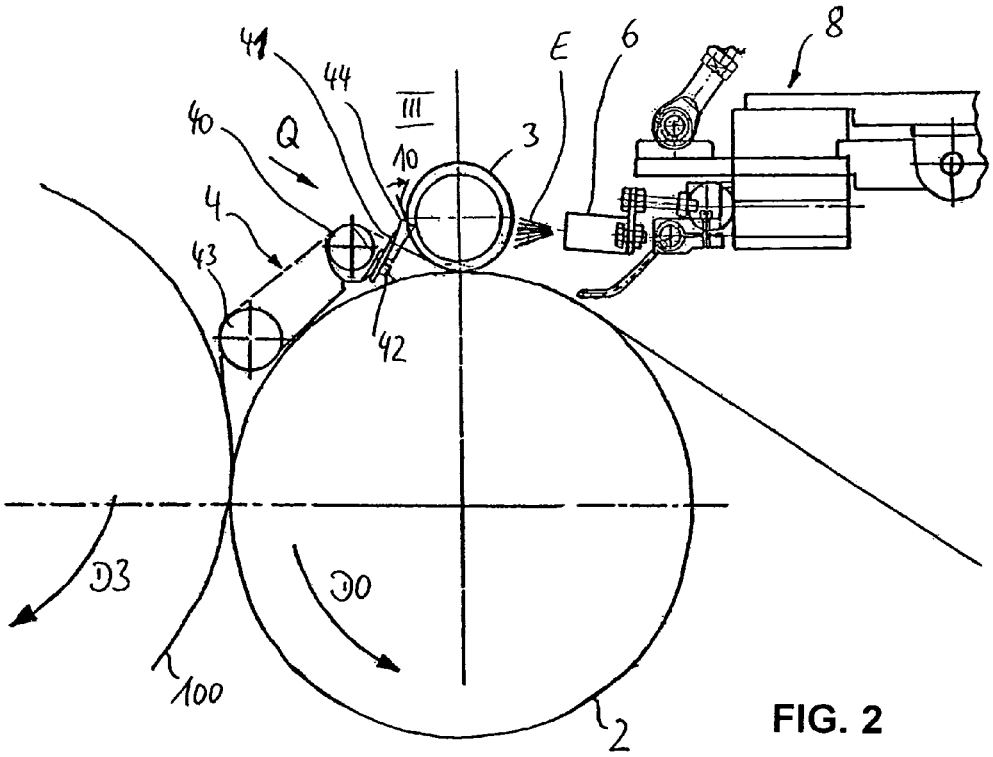
FIG. 2 is a schematic representation of greater details of the transverse cutting device employed in the device in accordance with FIG. 1.

Now a charging device 6, held on a pivot arm 8 and having a charge electrode extending over an entire width of the waiting fresh winding tube 3, is pivoted into the position represented in FIG. 2, and a strong electrostatic field E with a potential difference of approximately 40 kV, for example, with respect to the fresh winding tube 3, is generated by activating the charge electrode, as a result of which a brief strong electrostatic charging of the surface of the fresh winding tube 3 occurs.

The charge electrode remains switched on at least during the length of time of a full rotation of the fresh winding tube 3, preferably during several of its rotations, so that a uniform electrostatic charge of the entire circumferential surface of the fresh winding tube 3 is achieved. Now the transverse cutting device 4, which is already in its active position in accordance with FIG. 2, is activated for severing the web 1 of material fed in via the transverse cutting device transversely with respect to its feeding direction.

Figure 3:
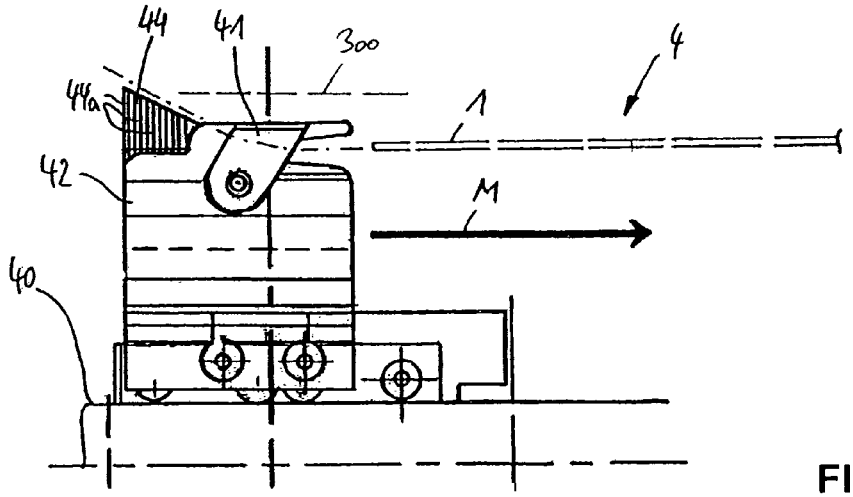
FIG. 3 shows a transverse cutting device in accordance with the arrow Q shown in FIG. 2.

As shown in greater detail from the representations of FIGS. 2 and 3, the transverse cutting device 4 has a support tube 40, also used for guiding the web 1 of material, in which a cutter block 42, which can be displaced in the direction of the arrow M and therefore transversely in relation to the feeding direction of the web of material, is displaceably conducted and can be displaced at high speed by a drive mechanism, not represented. The cutter block 42 supports a cutting blade 41, which severs the web 1 of material in the desired manner during the displacement of the cutter block 42 along the support tube 40, while the film web moves over the support tube 40 and a further guide tube 43 of the transverse cutting device 4. Viewed in the displacement direction M of the cutter block, an applicator brush 44 with elastic bristles 44*a* made, for example, of horsehair or hog bristles with a diameter of 0.05 to 0.1 mm, is further arranged trailing the cutting blade 41, which is also moved trailingly in the displacement direction M when the cutter block with the cutting blade 41 is moved.

Starting at the end adjoining the cutting blade 41, the applicator brush 44 has bristles 44*a* of increasing height.

Thus, when actuating the transverse cutting device 4 by accelerating and displacing the cutter block 42 along the support tube 40 in the direction of the arrow M, the indicated web 1 of material is severed transversely with respect to its feeding direction by the cutting blade 41 and is successively lifted by the trailing applicator brush 44, which is indicated by phantom lines in FIG. 3. The height of the bristles 44*a*, as well as the position of the transverse cutting device is selected so that the bristles 44*a* are conducted resting against the circumference, indicated by dashes 300, of the waiting fresh winding tube 3, so that the leading edge 10 of the web of material, which was lifted by the bristles 44*a* and severed immediately prior to this by the cutting blade 41, is dependably placed against the circumference of the waiting fresh winding tube 3 and adheres there because of the previously caused strong electrostatic charge, at least long enough until one or several complete rotations of the winding tube 3 are performed and the formation of a coil on this winding tube 3 is initiated.

Then the winding tube 30, on which a coil 100 was previously wound, can be removed from the winding station II in the direction of the arrow P2, and the transverse cutting device 4 is again moved into its standby position underneath the contact roller 2 in the direction of the arrow D0. Subsequently to or at the same time the fresh winding tube 3, on which the web 1 of material is already being wound, can be transferred from the winding-start station III into the winding station II in which the winding tube 3 is previously located, and a coil 100 can be wound on it in the same way until its exchange for a fresh winding tube 3 also becomes necessary.

Before the transverse cutting device 4 is again transferred into its active position for the next use, the cutter block 42 runs back in the support tube 40 into its position shown by solid lines in FIG. 3, for example opposite the direction of the arrow M.

Thus the device achieves a particularly high operational dependability during the right-handed rotation, in which the web 1 of material is wound up in a clockwise direction.

Figure 4:
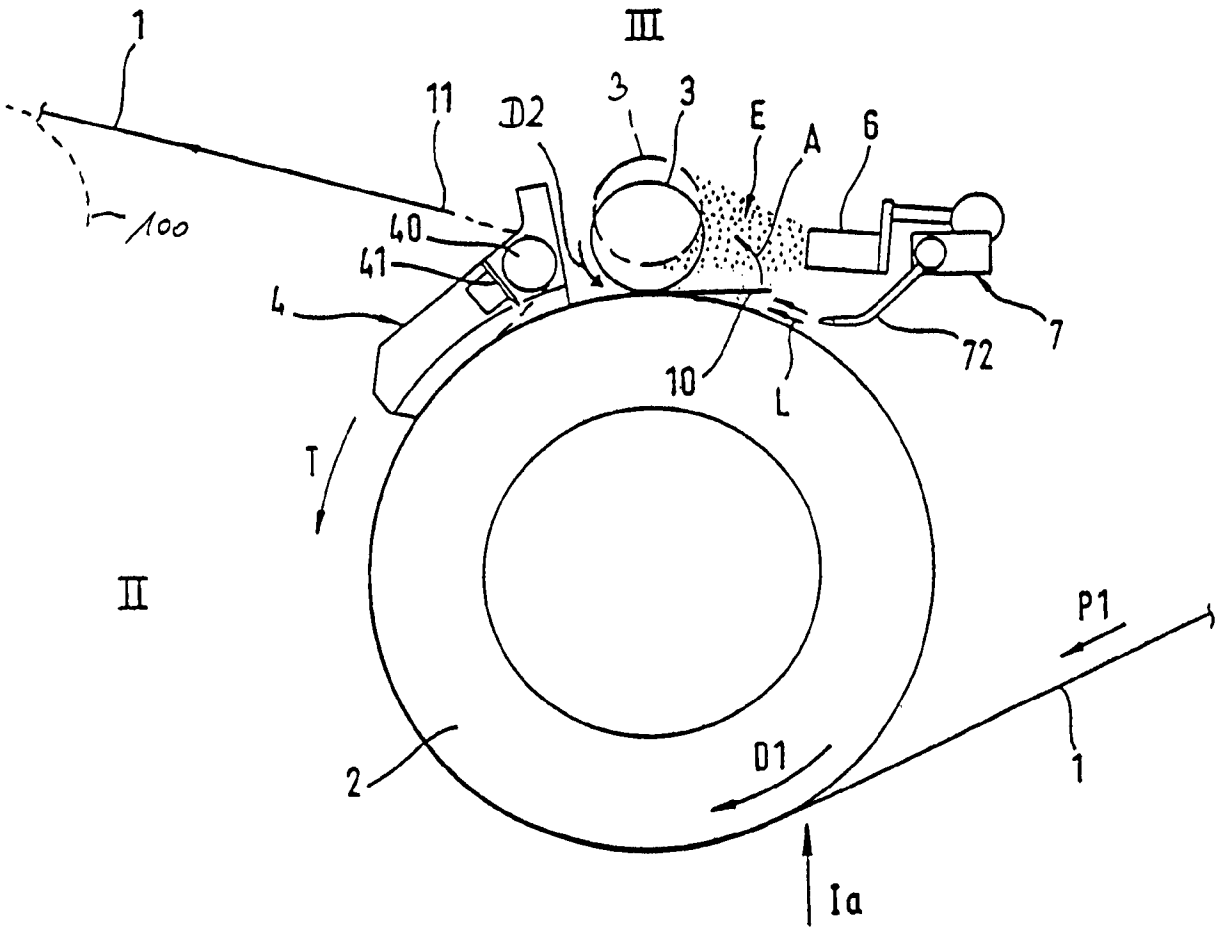
FIG. 4 shows the device in accordance with this invention but in an operational state differing from FIG. 1.

Also, the device for winding up the web 1 of material can be designed so that the contact roller 2 can also be operated in the opposite direction of rotation, which is shown in FIG. 4.

The web 1 of material then runs in the conveying direction represented by arrows onto the contact roller 2 rotating in a clockwise direction in the direction of rotation D1 in a lead-in station Ia, which corresponds to a 5 o'clock position, and is taken along with the contact roller 2 as far as the winding station II, in which the winding tube 30, which rotates by contact with the contact roller 2, is located and winds the web 1 of material into a coil 100.

After the coil 100 reaches a defined circumference, such as the desired length of the web 1 of material is wound on, a winding tube change is performed, wherein the full winding tube 30 on which the coil is wound is lifted off the circumference of the contact roller 2 in the direction of the arrow P2.

The transverse cutting device 4 is again displaced from its standby position into its active position, which also corresponds to the direction of rotation D1 of the contact roller 2, in the direction of the arrow F, wherein then the web 1 of material is deflected via the support tube and continues to be conducted to the coil 100.

Now a fresh winding tube 3, pushed on a winding roller, not represented, is taken from a storage magazine, also not represented, by the feeding device 5, which also contains a device for rotating and accelerating the winding tube 3 in the direction of rotation D2, so that the winding tube 3 can be placed from the feeding device 5 in the direction of the arrow P into a storage receptacle 50 at the contact roller 2 when the winding tube 3 reaches a desired number of revolutions corresponding to the circumferential speed of the contact roller 2. The fresh winding tube 3 is then placed on the contact roller 2, forming a contact gap, and is turned by the contact roller 2 in the direction D2. Now, the charging device 6 is again pivoted into the position already described in FIG. 2 by the pivotable holder, in which a strong electrostatic charge of the winding tube 3 waiting in the winding-start station III is caused by the electrostatic field E.

It is also possible to distinguish a blower arrangement 7 with blowing air nozzles 72, which is assigned to the charging device 6 and having nozzles that also extend at regular distances over the entire width of the web 1 of material and generate a strong air flow L in a direction toward the circumference of the fresh winding tube 3 and opposite the conveying direction of the web 1 of material.

No transverse cutting device having an applicator brush is required in this operating mode of the winding device. Rather, a cutting blade 41 arranged, viewed in the direction D1, in front of the support tube 40, is either exchanged with the cutting blade in accordance with FIGS. 1 to 3 or is additionally provided. Upon activation of the transverse cutting device, the cutting blade 41 severs the web 1 of material conducted around the transverse cutting device 4 in the position in accordance with FIG. 4 shortly before reaching the winding-start station III. Because of the transverse cutting of the web 1 of material by the transverse cutting device 4, the trailing end 11 of the leading web 1 of material is pulled off in the direction toward the winding tube 30 of the winding station II and forms the end of the coil 100. The leading new edge element 10 of the web 1 of material remains on the contact roller 2 and is transported by it in the direction toward the winding-start station III and is conducted through the contact gap between the contact roller 2 and the fresh winding tube 3.

As soon as the leading edge element 10 of the web 1 of material is passed through the contact gap, it comes under the influence of the air flow L from the blower arrangement 7.

The edge element 10 of the leading web 1 of material is lifted off the contact roller 2 in the direction of the arrow A by the air flow L, which flows opposite the conveying direction of the web 1 of material between the surface of the contact roller 2 and the leading edge 10 of the web 1 of material and is conducted against the surface of the winding tube 3, which is electrostatically charged by the electrostatic field E of the charging device 6, adheres to the surface and is taken along with it in the direction of rotation D2, so that the film end 10 is again wound on.

During the start of the winding of the film end 10 onto the fresh winding tube 3 in the winding-start station III, the winding tube 30 with the wound coil 100 on it is completely removed from the winding station II, and the transverse cutting device 4 is also pivoted back into the standby position between the winding station II and the lead-in station Ia. Now, the fresh winding tube 3, on which the web 1 of material is already wound, can be pivoted out of the winding-start station III into the winding station II in the direction of the arrow P, so that the further winding process of the web 1 of material can be performed in the winding station II.

In this operational state, in which the winding tube is moved in a counterclockwise direction, such as with left-handed rotation, the winding device for winding the continuously fed-in web 1 of material makes possible a dependable and interference-free operation, in particular also during a winding tube change.

European Patent Reference 03018005.3, the priority document corresponding to this invention, and its teachings are incorporated, by reference, into this specification.

What is claimed is:

1. A transverse cutting device (4) for a continuously fed-in web (1) of material which is wound onto sequentially positioned winding tubes (3), wherein the transverse cutting device (4) includes a cutter block (42) which is displaceable transversely with respect to the web (1) of material and is driveable by a drive mechanism in a displacement direction (V), and in which is mounted a cutting blade (41) for the transverse cutting of the web (1) the transverse cutting device (4) comprising: the cutter block (42) having an applicator brush (44) trailing the cutting blade (41) by which a leading edge (10) of the web (1) of material formed while being severed is successively placed against a circumference of a waiting winding tube (3), and starting at an end adjoining the cutting blade (41) the applicator brush (44) having bristles (44*a*) of increasing height.

2. The transverse cutting device (4) in accordance with claim 1, wherein the applicator brush (44) has bristles (44*a*) made of one of horsehair and hog bristles.

3. The transverse cutting device (4) in accordance with claim 2, wherein the bristles (44*a*) of the applicator brush (44) have a diameter of from 0.05 mm to 0.1 mm.

4. The transverse cutting device (4) in accordance with claim 3, wherein there is a charging device (6) for electrostatically charging the waiting winding tube (3).

5. The transverse cutting device (4) in accordance with claim 1, wherein the bristles (44*a*) of the applicator brush (44) have a diameter of from 0.05 mm to 0.1 mm.

6. The transverse cutting device (4) in accordance with claim 1, wherein there is a charging device (6) for electrostatically charging the waiting winding tube (3).

7. A winding device including the transverse cutting device (4) in accordance with claim 5, wherein the winding device for winding a continuously fed-in web of material onto the sequentially positioned winding tubes (3) has a rotatably driveable contact roller (2) in a conveying device for feeding the web (1) of material and, assigned to the contact roller (2) a winding station (II) for each of the winding tubes (3) for winding the web (1) of material into a coil (100), a winding-start station (III) for receiving a fresh winding tube (3) which during a winding tube change replaces each of the winding tubes (3) wound with a coil (100) of the web (1) of material in the winding station (II), a transverse cutting device (4) for transversely severing the web (1) of material between the winding station (II) and the winding-start station (III), wherein during a change of the winding tube (30), the winding tube (30) supporting the coil (100) removable from the winding station (II), the transverse cutting device (4) for transversely cutting the web (1) of material can be changeable from a standby position into a working position wherein when transversely cutting the web (1) of material a leading edge element (10) of the following web of material being formed, the leading edge element (10) of the web (1) of material thus formed conducted to the fresh winding tube (3) located in the winding-start station (III) and windable onto the fresh winding tube (3), and after picking up the leading edge element (10) of the web (1) of material the fresh winding tube (3) transferable from the winding-start station (III) into the winding station (II).

8. The winding device in accordance with claim 7, wherein the transverse cutting device (4) includes a charging device (6), by which the fresh winding tube (3) is electrostatically charged.

9. The winding device in accordance with claim 8, wherein the winding tube (3) is of an electrically non-conducting material.

10. The winding device in accordance with claim 9, wherein the contact roller (2) is selectively driven in different directions of rotation.

11. A winding device including the transverse cutting device (4) in accordance with claim 1, wherein the winding device for winding a continuously fed-in web of material onto the sequentially positioned winding tubes (3) has a rotatably driveable contact roller (2) in a conveying device for feeding the web (1) of material and, assigned to the contact roller (2) a winding station (II) for each of the winding tubes (3) for winding the web (1) of material into a coil (100), a winding-start station (III) for receiving a fresh winding tube (3) which during a winding tube change replaces each of the winding tubes (3) wound with a coil (100) of the web (1) of material in the winding station (II), a transverse cutting device (4) for transversely severing the web (1) of material between the winding station (II) and the winding-start station (III), wherein during a change of the winding tube (30), the winding tube (30) supporting the coil (100) removable from the winding station (II), the transverse cutting device (4) for transversely cutting the web (1) of material can be changeable from a standby position into a working position wherein when transversely cutting the web (1) of material a leading edge element (10) of the following web of material being formed, the leading edge element (10) of the web (1) of material thus formed conducted to the fresh winding tube (3) located in the winding-start station (III) and windable onto the fresh winding tube (3), and after picking up the leading edge element (10) of the web (1) of material the fresh winding tube (3) transferable from the winding-start station (III) into the winding station (II).

12. The winding device in accordance with claim 11, wherein the transverse cutting device (4) includes a charging device (6), by which the fresh winding tube (3) is electrostatically charged.

13. The winding device in accordance with claim 12, wherein the winding tube (3) is of an electrically non-conducting material.

14. The winding device in accordance with claim 13, wherein the contact roller (2) is selectively driven in different directions of rotation.

* * * * *